United States Patent [19]

Stoddard et al.

[11] 4,051,889

[45] Oct. 4, 1977

[54] HEATING FRASCH SULPHUR MINE WATER USING WASTE HEAT

[76] Inventors: Xerxes T. Stoddard, 4617 W. 27th Ave., Denver, Colo. 80212; Ruel C. Terry, 3090 S. High St., Denver, Colo. 80210

[21] Appl. No.: 670,986

[22] Filed: Mar. 26, 1976

[51] Int. Cl.[2] ..... F28D 17/00

[52] U.S. Cl. ..... 165/1; 165/45

[58] Field of Search ..... 165/1, 45

[56] References Cited

U.S. PATENT DOCUMENTS

| | | | |
|---|---|---|---|
| 3,274,769 | 9/1966 | Reynolds | 165/45 |
| 3,911,683 | 10/1975 | Wolf | 165/45 |

*Primary Examiner*—Wendell E. Burns
*Assistant Examiner*—Daniel J. O'Connor
*Attorney, Agent, or Firm*—Ruel C. Terry

[57] ABSTRACT

A Frasch process sulphur mine power plant is coupled to a steam-electric generating plant by a coupling heat exchange means, wherein the heat liberated by condensing steam is substantially used to bring Frasch mine water up to operating temperature.

8 Claims, 2 Drawing Figures

HEATING FRASCH SULPHUR MINE WATER USING WASTE HEAT

BACKGROUND OF THE INVENTION

The uses of energy in the United States during the past century have been developed during a period of cheap energy. As a result many uses have been designed that are quite wasteful from an energy point of view, but economic in the overall point of view. With sharply rising costs of energy in recent times, many designs for energy that were economically attractive in the past are becoming economically unsound in the face of rising energy costs. As a result buildings that were not insulated in the past because it was cheaper to waste fuel than to pay for insulation are now being insulated, designs for processes that were basically wasteful of energy are undergoing redesign, and the like.

It is well known in the art how to generate steam by burning a source of energy and then expanding the steam through a turbine to generate electricity. This process is basically wasteful of energy because in heating water it requires one BTU of heat to raise one pound one degree Farenheit; at the point water is converted from liquid to vapor, approximately 1000 BTUs of heat are required for each pound of water vaporized; upon becoming dry vapor the steam may be raised to higher temperatures with modest increases in heat added per pound of steam; the steam is expanded through a turbine which in turn generates electricity; then the remaining steam is condensed to water by giving up approximately 1000 BTUs per pound to the cooling towers and cooling ponds. It is this latter heat loss that significantly diminishes the overall efficiency of the process where efficiencies in the order of 33% are common.

The electric generating industry has devoted considerable research in an attempt to minimize these losses without notable success. One scheme has been to pull a partial vacuum on the discharge side of the turbine to lower the boiling point of water to temperatures in the atmospheric air range. Another scheme is to eleminate the low pressure turbine and deliver steam from the intermediate pressure turbine to a metropolitan area where the steam is used for the heating of buildings with the condensate returned to the steam-electric generating station for recycling. In the first scheme enormous quantities of low grade heat are wasted by heating the water of cooling ponds or lakes so that approximately one pound of water will be evaporated for each pound of steam condensed. In the second scheme the use of steam for heating buildings must of necessity be limited to the requirements of the buildings for heat.

In general an electric generating station must be operated at different rates of output to meet the demand for electricity. This demand may vary widely over a 24 hour period, which adds complications to plans for utilization of heat that otherwise would be wasted.

One industry that uses a considerable amount of heat each 24 hours on a year around basis is sulphur mining using the Frasch process. In this process water is heated to a temperature well above the melting point of sulfur (240° F) and is kept under pressure as water to avoid the heat requirement necessary to convert water to vapor and the heat loss of converting the vapor back to water. At the sulphur mine the water is brought up to temperature in the typical range of 330° to 360° F for injection into the underground sulphur formation. A typical sulphur mine will have a multiplicity of sulphur wells, each well having a capability of taking water over a wide range of injection rates. It is this flexibility in taking water in the individual wells that makes a Frasch process sulphur mine an ideal candidate to couple with a steam-electric generating station because the swing in electric output requirements can be matched with a corresponding swing in the hot water input to the sulphur mine. These swings can be accomplished without regard to the time of day or to the season of the year.

OBJECTIVES OF THE INVENTION

It is an object of this invention to show how an electric generating station can be coupled with a Frasch process sulfur mine resulting in a substantial saving in heat that otherwise would be wasted.

It is an object of this invention to show how a steam-electric generation station can be operated to swing with the load while operating in concert with a Frasch process sulfur mine.

Other objectives, advantages and capabilities of the present invention will become more apparent as the description proceeds and in conjunction with the accompanying drawings.

SUMMARY OF THE INVENTION

No particular novelty is claimed in the use of energy to generate steam which in turn drives a turbine that generates electricity. No particular novelty is claimed in the use of hot water to mine an underground sulphur deposit.

In commercial practice of the present invention a multiplicity of heat exchangers would be employed to couple the steam-electric generating station to the Frasch process sulphur mine, but for purpose of illustration only two heat exchangers are described. The steam-electric generating station operates by heating water to steam at, for example 1000° F, then discharging the steam first through a high pressure turbine, second through an intermediate pressure turbine, then delivering steam at 500° F to the coupling heat exchanger. The steam-electric generating station is further equipped with an economizer so that the sensible heat from the products of combustion is transferred to inbound Frasch mine water, raising the temperature of the Frasch mine water from ambient to for example 190° F. Steam from the intermediate pressure turbine discharge is delivered to the coupling heat exchanger at for example 500° F with a pressure of for example 600 pounds per square inch with a heat content for example of 1200 BTUs per pound. Frasch mine water at a temperature of for example 190° F is also delivered to the coupling heat exchanger. The steam is condensed in the coupling heat exchanger with the condensate exiting at for example 240° F for return to the steam-electric generating station for recycling. The heat liberated by condensing the steam is transferred to the Frasch mine water which enters the coupling heat exchanger at for example 190° F and exits at for example 330° F. Sufficient pressure is maintained on both sides of th heat exchanger to keep the condensate and the water below the bubble point.

Figure 1:
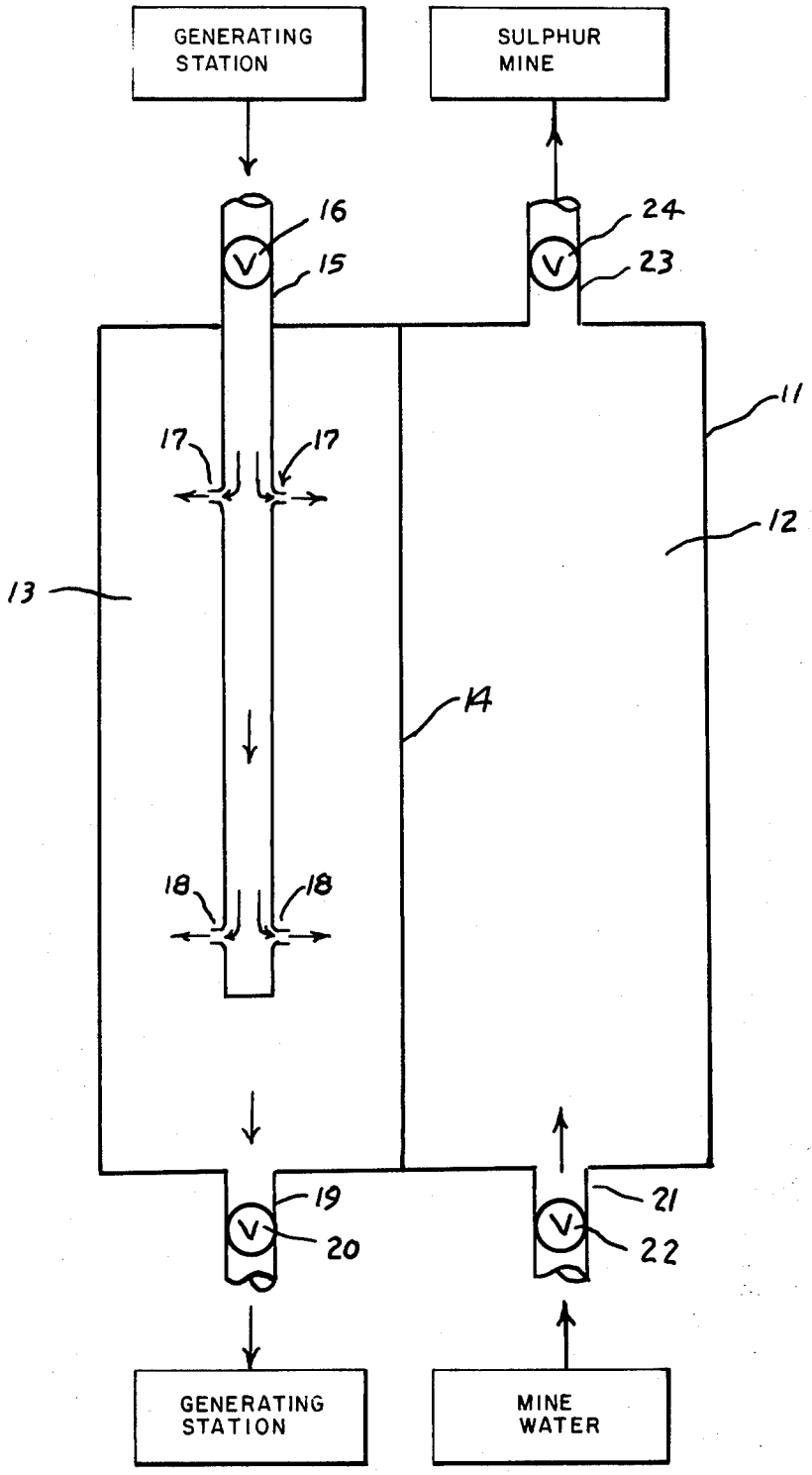
FIG. 1 is a diagrammatic vertical section shown in block form taken through a heat exchanger that couples the steam-electric generating station to the Frasch process sulphur mine wherein the condensate is returned to the steam-electric generating station for recycling.

Referring to FIG. 1, the coupling heat exchanger 11 is composed of two compartments. One compartment 12 receives the Frasch mine water and a second compartment 13 receives the steam. Leading into compartment 13 is steam distribution tubing 15 containing valve 16 and jets 17 and 18. From compartment 13 the condensate exits through tubing 19 which contains valve 20. The Frasch mine water enters compartment 12 through tubing 21 which contains valve 22, and exits through tubing 23 which contains valve 24. The heat exchange between compartment 13 and compartment 12 is made through heat exchange surface 14. The external portion of coupling heat exchanger 11 and the external portions of inbound and outbound tubing and valves is properly covered with appropriate insulation (not shown) to minimize heat losses. The steam dispersal jets 17 and 18 are shown in two locations within compartment 13 for illustrative purposes, while it is recognized that those skilled in the art will envision optimum locations for the various steam dispersal jets that could be used.

DESCRIPTION OF THE PREFERRED EMBODIMENT

The process of coupling a steam-electric generating station to a Frasch sulphur mine begins preferably by filling compartments 12 and 13 with water at ambient temperature. Valve 16 is opened to admit steam at for example 500° F and a pressure of 600 psi while valve 20 is opened to the extent necessary to maintain a proper back pressure in compartment 13, for example 200 psi. The steam is expanded through jets 17 and 18 and is condensed within compartment 13 to water (sometimes called condensate), liberating heat to the fluids in compartment 13. Concurrently Frasch mine water enters compartment 12 through tubing 21 by opening valve 22, and exits from compartment 12 via tubing 23 by opening valve 24 to the extent necessary to hold backpressure within conpartment 12. The preferred pressure in compartment 12, for example, is in the order of 150 psi, and in any event a pressure of sufficient magnitude to exceed the bubble point pressure of the water in compartment 12. The Frasch mine water enters the coupling heat exchanger 11 at a temperature of, for example, 190° F and exits at a temperature of, for example, 330° F. The rate of flow of the Frasch mine water through compartment 12 is regulated with due regard for the residence time required to absorb the heat necessary to raise the temperature to the desired level.

Preferably, before the Frasch mine water reaches the coupling heat exchanger 11 it has been circulated through an economizer (not shown) that raises the temperature of the water from ambient to approximately 190° F. The economizer, which in itself is a heat exchanger, is located preferably in the exit gas stream of the products of combustion from the steam-electric generating station wherein a portion of the sensible heat is transferred to the circulating Frasch mine water before the products of combustion are vented to the atmosphere. As an alternate, the Frasch mine water may be directed to the coupling heat exchanger 11 at ambient temperature.

Preferably the steam injected into compartment 13 is distributed at a variety of locations within the compartment and at a variety of pressures within the range of pressures between the maximum inlet pressure of the steam and the minimum exit pressure of the condensate. This variety of locations and pressures can be accomplished by proper selection of the locations of the jets in concert with the proper selection of the orifice sizes within the jets. It is desirable to have the variety in locations and pressures so that steam will be condensing at a variety of temperatures. Since steam upon condensing to water must give up the heat approximating that of the latent heat of vaporization of water, for example approximately 1000 BTUs per pound, it is highly desirable that this heat be available for transfer from compartment 13 to compartment 12.

In some cases it may be impractical to make the heat transfer in coupling heat exchanger 11 so that the Frasch mine water exits in the range of 330° F to 360° F. Should this be the case, the Frasch mine water may be withdrawn from compartment 12 at a temperature for example of 300° F, then the Frasch mine water can be brought up to the desired temperature by adding an after-heater (not shown) connected with tubing 23. The after-heater also can be used to increase the output of hot water to the Frasch mine when the steam-electric generating plant is not furnishing enough heat during periods of low demand for electricity.

Figure 2:
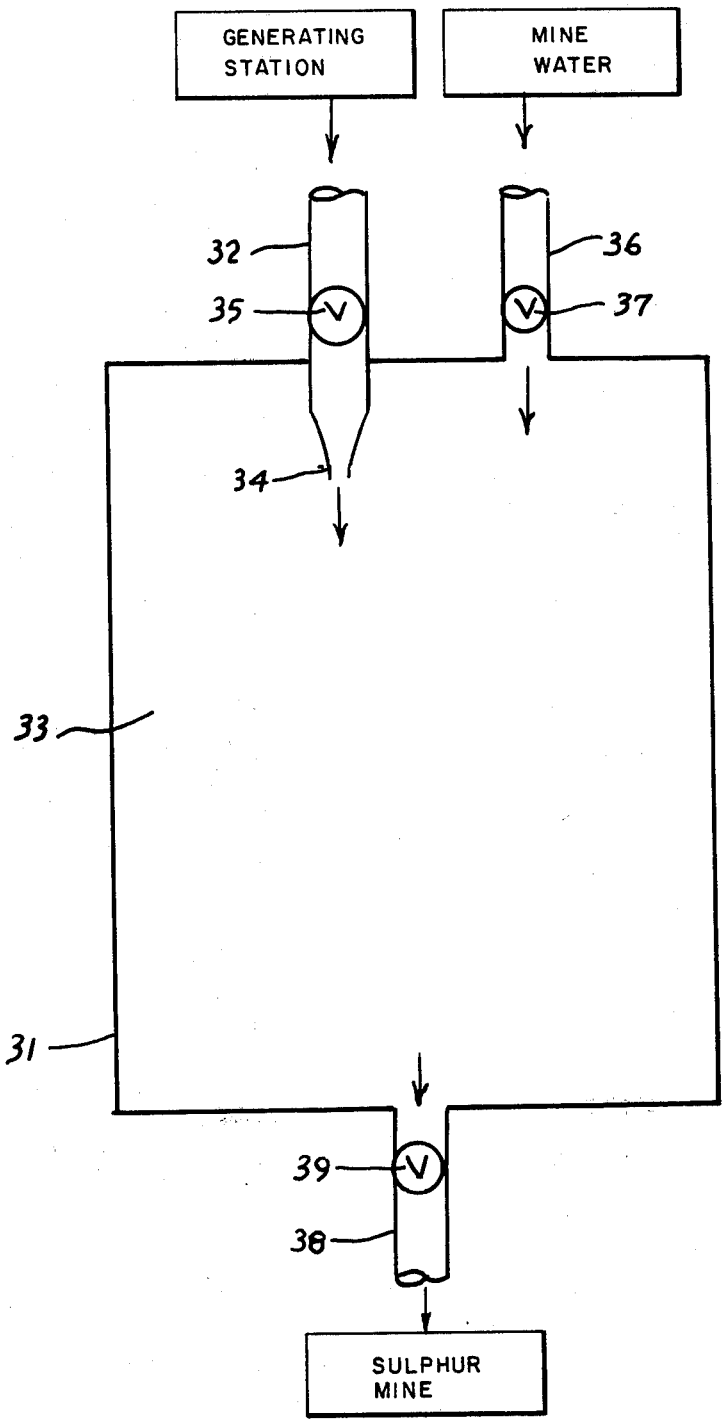
FIG. 2 is a diagrammatic vertical section shown in block form taken through a heat exchanger that couples the steam-electric generating station to the Frasch process sulphur mine wherein the condensate becomes a part of the Frasch mine water.

Referring to FIG. 2 an alternate embodiment of the coupling heat exchanger is shown. The coupling heat exchanger 31 is equipped with a steam injection line 32 which discharges steam into compartment 33 through nozzle 34 with the injection rate controlled by valve 35. Inbound Frasch mine water enters compartment 33 by tubing 36 with inbound flow rates controlled by valve 37. Unlike the preferred embodiment described above wherein the condensate is returned to the steam-electric generating station for recycling, the condensate in this alternate embodiment becomes a part of the Frasch mine water and is thus delivered to the underground sulphur deposit. The temperature differential between the inbound steam and the inbound Frasch mine water is of sufficient magnitude to cause considerable turbulance and a consequent thorough mixing. The outbound Frasch mine water exits from compartment 33 via tubing 38 which contains valve 39. Valve 39 can be regulated to maintain the proper pressure in compartment 33 so that the pressure is maintained at a level above the bubble point pressure of the exiting Frasch mine water. The coupling heat exchanger 31 and the external surfaces of inbound and outbound tubing and valves are suitably (not shown) to minimize heat losses.

For the alternate embodiment the process begins by filling compartment 33 with water for example from tubing 36. Valve 35 is opened permitting steam at a temperature of for example 500° F from the steam-electric generating station to be injected into compartment 33. Concurrently valve 39 is opened to the extent necessary to hold back pressure so that the pressure in compartment 33 is maintained in the order of for example 150 psi. The water in compartment 33 rapidly comes up to temperature desired, for example 330° F, at which time valve 37 is opened to permit entrance of Frasch mine water at a temperature of for example 190° F. The process continues by operating valves 35, 37 and 39 in concert to yield the proper temperature of the Frasch mine exit water. In this alternate embodiment as well as the preferred embodiment described previously it may be desirable to control the liquid level in the coupling heat exchanger. This can be accomplished by installing a liquid level sensor that serves to control the valve in the water exit flow line.

In planning for the coupling of a steam-electric generating plant with a Frasch process sulphur mine, the primary limitation is the maximum capability of the Frasch mine to receive water. This maximum capability is then matched with the maximum expected delivery of useable heat from the steam-electric generating station. With this match-up the coupling heat exchanger can be designed and the two facilities can be tied together. The steam electric generating station can then be operated to match the varying power demands during each 24 hour period, and the Frasch process sulphur mine can be operated successfully within these variations. The savings in fuel costs as a result of operating the plants coupled together approximates the cost of fuel for the Frasch plant should it be operated as a separate plant.

Although the present invention has been described with a certain degree of particularity, it is understood that the present disclosure has been made by way of example and that changes in details of structure may be made without departing from the spirit thereof.

What is claimed is:

1. A method of coupling a steam-electric generating station to a Frasch process sulphur mine so that a portion of the waste heat from electric generation can be used in the process of mining sulfur, comprising the steps of establishing a coupling heat exchange means, diverting exhaust steam from the steam-electric generating plant into the coupling heat exchange means, circulating mine water through the coupling heat exchange means, reducing the pressure of the steam within the coupling heat exchange means, condensing the steam into water within the coupling heat exchange means with the resultant liberation of heat, transferring the heat from the hotter steam and condensed steam to the cooler circulating mine water, withdrawing the mine water, and directing the mine water to the sulphur mine.

2. The method of claim 1, further including the steps of establishing a first compartment adjacent to a second compartment within the coupling heat exchange means.

establishing a heat transfer communication means between the first compartment and the second compartment, segregating the circulating steam and condensed steam into the first compartment, segregating the circulating mine water into the second compartment, withdrawing the condensed steam as water from the first compartment, and returning the withdrawn condensed steam as water to the steam-electric generating plant.

3. The method of claim 1, further including the steps of condensing the steam by expanding the steam through a nozzle means located in the coupling heat exchange means, and mixing the condensed steam as water with circulating mine water within the coupling heat exchange means.

4. The method of claim 2 wherein the pressure in the first compartment is maintained above the bubble point pressure of the condensed steam withdrawn as water.

5. The method of claim 2 wherein the pressure in the second compartment is maintained above the bubble point pressure of the withdrawn mine water.

6. The method of claim 3 wherein the pressure in the coupling heat exchanger is maintained above the bubble point pressure of the withdrawn mine water.

7. The method of claim 1 wherein the pressure of the steam is reduced by expansion through more than one orifice within the coupling heat exchange means.

8. The method of claim 7 wherein the orifices are spaced at intervals within the coupling heat exchange means.

* * * * *